United States Patent [19]

Sarda

[11] Patent Number: 4,889,051

[45] Date of Patent: Dec. 26, 1989

[54] REMOVABLE INKING DEVICE FOR OFFSET PRESS

[76] Inventor: Jean-Claude Sarda, 48 Avenue Claude Vellefaux, Paris, France, 75010

[21] Appl. No.: 224,071

[22] Filed: Jul. 25, 1988

[30] Foreign Application Priority Data

Aug. 3, 1987 [FR] France ..... 87 10972

[51] Int. Cl.[4] ..... B41F 7/06; B41F 7/10; B41F 13/40

[52] U.S. Cl. ..... 101/77; 101/137; 101/177; 101/247

[58] Field of Search ..... 101/177, 181, 182, 185, 101/184, 136, 137, 139, 140, 142, 143, 144, 145, 76, 77, 91, 247

[56] References Cited

U.S. PATENT DOCUMENTS 4,111,120 9/1978 Paulson ..... 101/177

4,426,929 1/1984 Fujisawa ..... 101/76

*Primary Examiner*—J. Reed Fisher

[57] ABSTRACT

A detachable printing unit for offset printing presses, which can be incorporated during their manufacture or fitted to existing presses, said unit being defined in that it is composed of an independent inking module 16 (FIG. 3) comprising all the components required for effecting in chronological operating order the moistening and inking of an offset plate ready for printing on a blanket, and a likewise independent detachable blanket cylinder 7C. One embodiment of the invention is defined in that the numbering device with which the press is equipped (FIG. 6, View B) is replaced by the blanket cylinder (FIG. 7, View B) of the printing unit working with the inking module 16 (FIG. 3), and use is made of the drive mechanism 8 (FIG. 6) and pressure adjustment mechanism 9B provided in the press to obtain for each printing cycle, instead of the numbering, an additional color obtained by color superimposition with the aid of the pressure cylinder 4. In the other form of the invention the same inking module, disposed in another position in the press, works conjointly with the blanket cylinder 3 of the press to enable for each printing cycle an additional color and optionally letterpress numbering or an additional letterpress color to be achieved.

6 Claims, 10 Drawing Sheets

REMOVABLE INKING DEVICE FOR OFFSET PRESS

FIELD OF THE INVENTION

The present invention relates to a detachable printing unit adapted to be fitted to existing offset printing presses or to be incorporated in such presses during their manufacture.

BACKGROUND OF THE INVENTION

This printing unit consists of an inking module and a blanket cylinder, which are independent of one another, in such a manner as to enable the inking module to be used alone or conjointly with the blanket cylinder.

In one form the invention is defined in that the numbering device with which the press is equipped is replaced by the blanket cylinder of the printing unit working with the inking module, and use is made of the drive mechanism and pressure adjustment mechanism provided in the press to obtain for each printing cycle, instead of the numbering, an additional color obtained by color superimposition.

In the other form of the invention the same inking module, disposed in another position in the press, works conjointly with the blanket cylinder of the press to enable for each printing cycle an additional color and optionally numbering to be achieved.

SUMMARY OF THE INVENTION

At the present time the great majority of professional offset printing presses are designed to print three or four colors. Their mode of operation differs little from one manufacturer to another, and the choice made by the printer is guided by the reliability of the presses, the simplicity of starting them up and operating them, and their production possibilities.

The operating principle of a traditional GTO Heidelberg press, which is representative of this type of machine and for that reason has been chosen to illustrate the invention, is descried schematically below by way of indication and with reference to the accompanying drawings.

The press shown in FIG. 1 consists of a frame 1 containing all the elements of which the press is composed. The inking unit 2A and its dampener 2B (inking rollers shown solid and dampening rollers hatched) moisten and ink the offset plate fixed on the plate cylinder 2. The inked plate prints its image on the blanket of the blanket cylinder 3. The paper 5 coming from the stack 5A is printed by transfer as it passes between the blanket cylinder 3 and the pressure cylinder 4. The printed sheet is taken up by the grippers of the chain delivery device 6, and is then deposited on the delivery stack 5B. The ink duct 2C and the system effecting dampening from the water reservoir 2D are provided with means enabling the supply of ink and water to be metered in dependence on the ink load necessary for the type of printing to be done. The plate cylinder 2 is provided with means for attaching and aligning the offset plate and with adjustment facilities for moving it circumferentially relative to the blanket cylinder 3, so as to achieve good positioning of the impression on the stock to be printed. The blanket cylinder 3 is also provided with the mechanical elements necessary for the fixing and tensioning of the blanket. The pressure cylinder 4 is provided with grippers for holding the sheet during printing.

A detachable letterpress numbering and additional color device 7 (FIG. 2) is included in these presses and operates in the following manner:

The inking unit 7A inks the numberers 9B or the letterpress blocks, which deposit their impression directly on the sheet 5 which has just received its offset impression from the blanket of the blanket cylinder 3. This letterpress printing is effected in line in the same printing cycle as the offset printing and in perfect register with the latter, the drive means being synchronized and interconnected. The pressure necessary for this letterpress printing is obtained between the pressure cylinder 4 (as in offset printing) and the numberers or letterpress blocks. The adjustment screws 7B placed on each side of the press permit micrometer adjustment of the pressure of the shaft carrying the numberers or blocks. The chronological order determined for carrying out the different operations leading to the impression is arranged by various control levers designed for achieving this order. All these functions are synchronised for each printing cycle. These presses are provided with a very accurate sheet positioning mechanism enabling them to achieve perfect register of each color in the case of successive impressions on the same sheet. This type of professional presses is also made for two, four and five colors. These multicolor presses are formed by grouping together a number of basic one-color presses. The sheet passes in succession from one press to the other, use being made of mechanisms carrying it positively with the aid of grippers. In these presses the numbering device is disposed on the final printing press. Certain makers offer as an option an additional inking unit, usually detachable, for one offset color. These units are independent and are provided with all elements required for moistening and inking an offset plate fixed on a plate cylinder of the same diameter as that of the basic press, as well as the control mechanisms required for the chronological sequencing of all the functions. This inked plate prints its image on the blanket of the press, which consequently receives two inked images of different colors for each impression cycle. These two images are transferred simultaneously to the sheet passing between the blanket cylinder and the pressure cylinder of the press. These added units are in most cases not made by the large manufacturers of printing presses. One American manufacturer has specialized in this type of printing units adapted to be fitted to all kinds of presses, and many American and foreign printers use them successfully because these added units are very useful to printers, although they do not make it possible to obtain, in a positive manner, superimposed screen impressions without the risk of pollution by the intermixing of the inks, and to do this within a printing time the length of which varies with the amount of superimposed images to be inked.

This serious restriction, due to the principle of these added units, to a great extent limits their use and does not enable the printer to regard his press, equipped with this accessory, as a true two-color press.

The evolution of graphic style, of tastes and of printing techniques makes it necessary to produce multicolor prints inexpensively. For many printers not specializing in color printing the purchase of a two-color press is a problem, because the cost and size of such a press are twice those of a single-color press, thus making amortization difficult. This factor is all the more important in the case of high quality presses for relatively small formats, of the GTO type, which for long runs of four-color printing find it difficult to compete with presses for double or quadruple format. In addition, a two-color press is poorly suited to one-color printing.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

The present invention seeks to improve the present state of the art by making it possible to produce compact offset presses offering increased facilities to the printer.

Within the scope of the invention the additional means provided for a traditional offset printing press can be defined generally as follows:

(a) a detachable inking module of traditional, known type whose inking power usually corresponds to that of the press and which has its own dampening unit, inking unit and plate cylinder, as well as all the mechanisms enabling the offset plate to be inked in chronological order.

(b) a detachable blanket cylinder mounted on the shaft of the numbering or additional color letterpress device of the press and replacing said device.

Starting with these two components of the printing unit, and depending on their arrangement on the press, the printer can at will, and within a short time, convert his single-color press either into a true two-color press offering the same possibilities and performance as a two-color press built on the basis of two presses, or into a single-color press plus an additional color and a numbering unit.

A third facility is offered in these presses provided with means for fitting these different components, namely the ability to mount another added unit on the press converted into a true two-color press.

If the press which is to be equipped with an additional printing unit is not provided with a numbering device, a device of this kind can be added and its drive shaft will be used in the same manner as with a press originally equipped to support and drive the blanket cylinder.

In addition to the fitting of the additional units to existing presses, the construction of presses directly fitted during their production with the same detachable modular components, without departing from the scope of the present invention, is also desirable, because this makes it possible to produce, at lower cost, two-color machines which can equally well print one or two colors or twice two colors and which are much more compact and easy to use, while offering not negligible additional facilities. It is quite obvious that the printing unit may allow wide variations in its inking or dampening methods or may effect waterless offset printing, without departing from the scope of the invention.

These different possibilities are of great interest to the printer, because in the case of color superimposition printing there is rarely a need for numbering, whereas numbering jobs often require an additional color.

Figure 1:
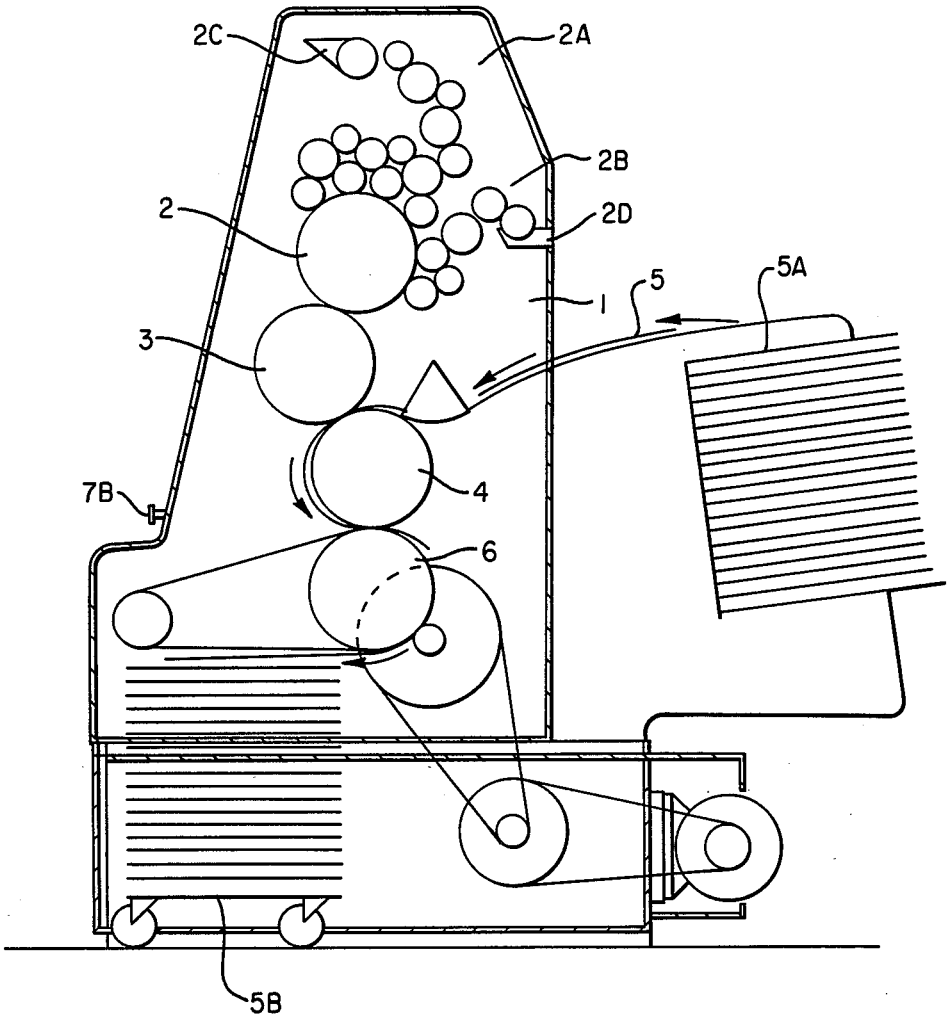
FIG. 1 PRIOR ART
FIG. 1 is a simplified side view of a prior art Heidelberg press.
Figure 2:
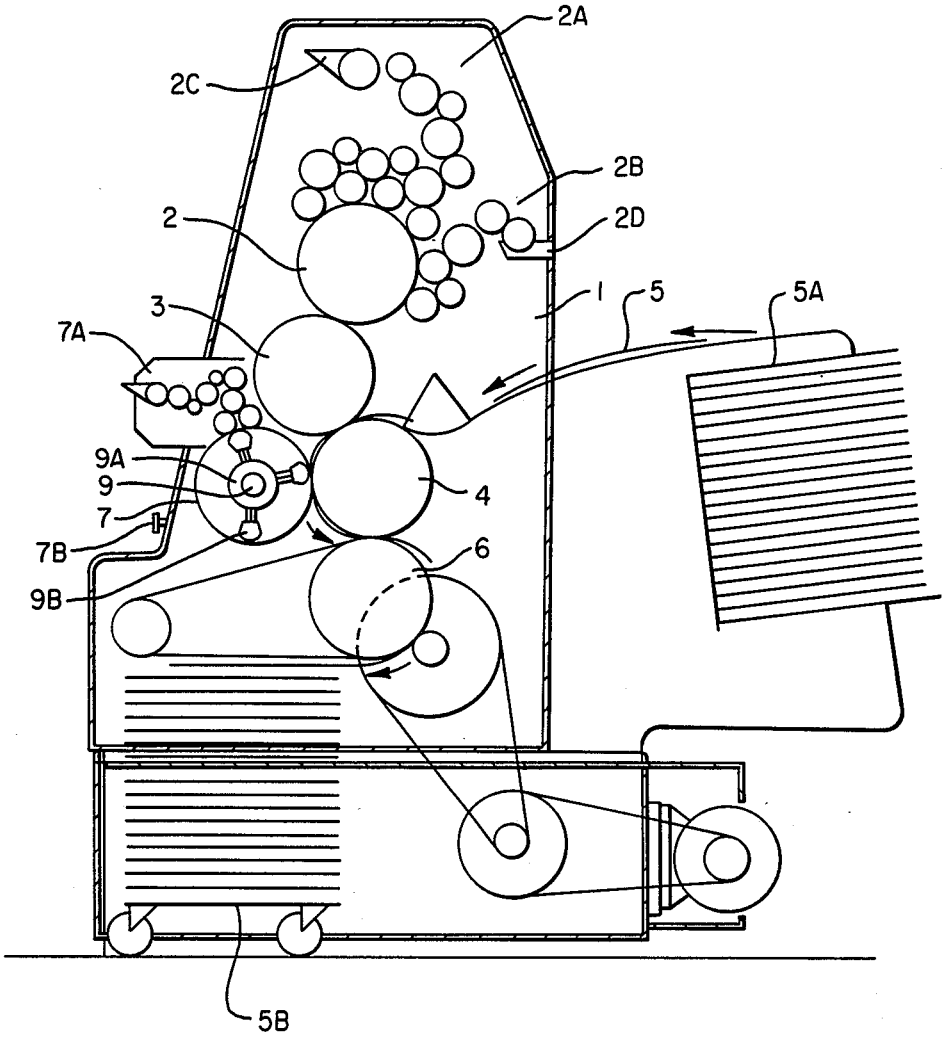
FIG. 2 PRIOR ART
FIG. 2 is a simplified side view of a prior art Heidelberg press with a detachable letter press numbering unit attached thereto.
Figure 3:
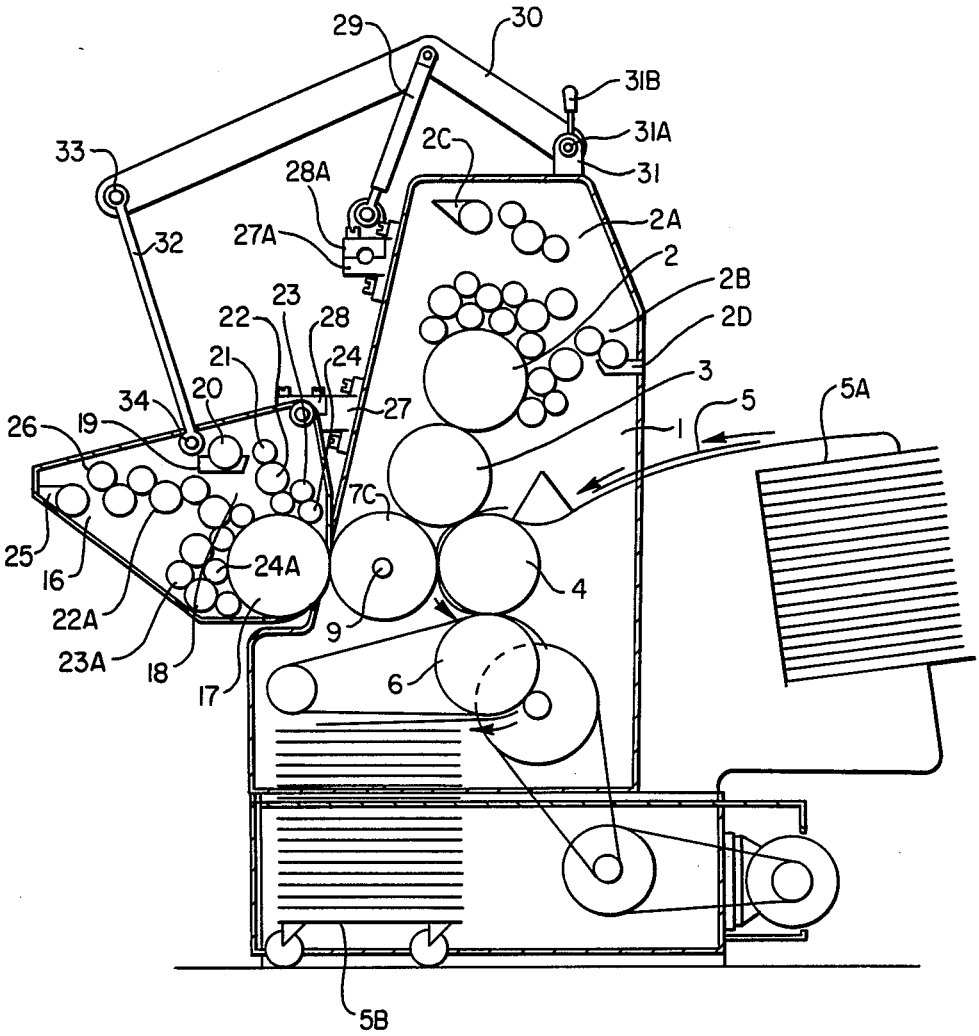
FIG. 3 is a simplified side view of a Heidelberg press of the present invention especially adapted according to the present invention with an auxiliary blanket cylinder and a detachable plate cylinder and inking module, which allows two color printing with a single press run.

FIG. 3 shows the printing unit in which the detachable inking module 16 works with its blanket cylinder 7C to provide an additional color by color superimposition in conjunction with the color of the press. This blanket cylinder 7C is mounted direct on the same shaft 9 which carries the rings 9A (FIG. 2) carrying numbers 9B. The drive is provided by the gear 8 (FIG. 9), which serves to operate the letterpress inking and additional printing unit 7A (FIG. 2) used for numbering.

The plate cylinder 17 (FIG. 3) is provided with all the usual devices for the tensioning and alignment of the plate, as well as for circumferential and axial adjustment to allow good positioning of the printing on the sheet. The dampening unit 18 transfers the moistening liquid from its reservoir 19 to the plate cylinder 17 with the aid of the conventional system comprising the water ductor 20, feed roller 21, sliding table 22, moistening roller 23, and plate moistening rollers 24. The ink contained in the duct 25 is fed and and ground as far as the plate inking rollers 24A inking the offset plate with the aid of the duct rollers 26, distribution rollers 23A, and grinding cylinder 22A. The sheet of paper 5 taken from the stack 5A is pressed in succession by the pressure cylinder 4 first against the blanket cylinder 3 normally installed on the press and printing the first color, and then secondly against the blanket cylinder 7C, which prints the second color. The sheet 5, having received the inks of two colors, is taken over by the grippers of the chain delivery device 6 and deposited on the delivery stack 5B.

Figure 4:
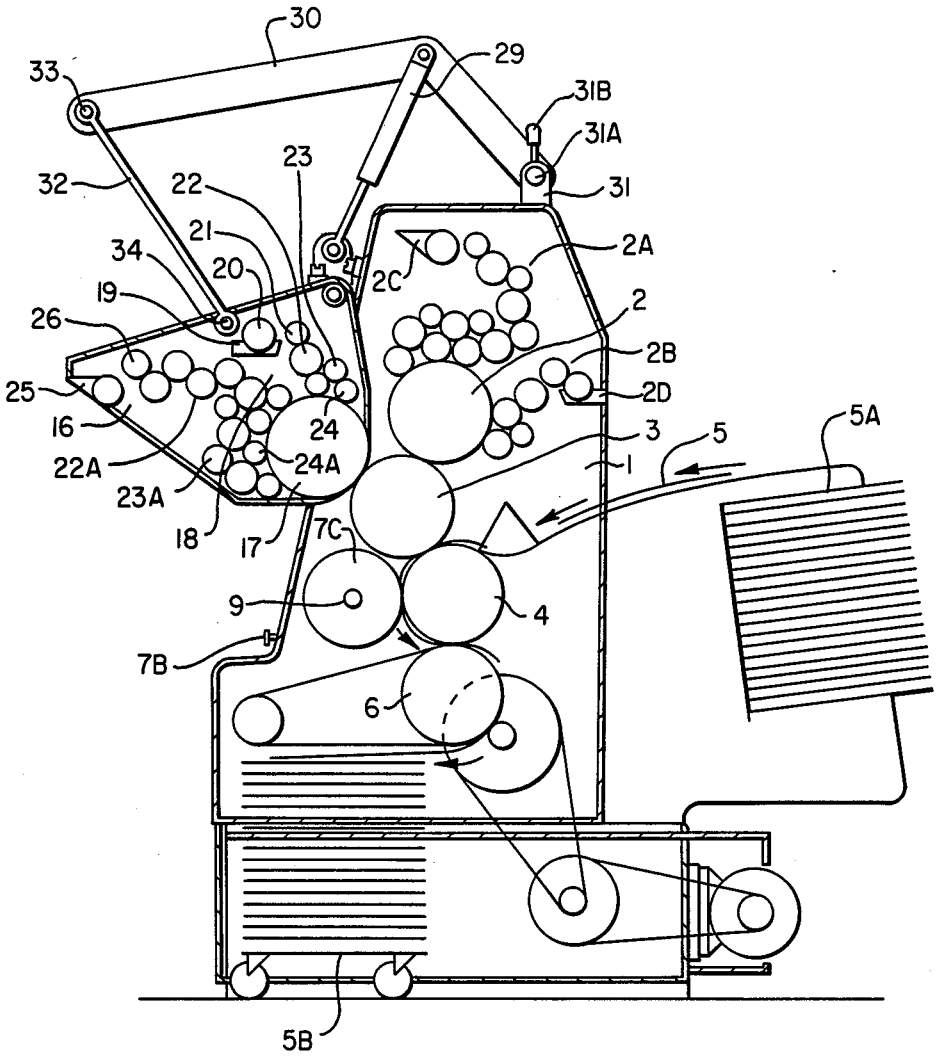
FIG. 4 depicts the improved press of the present invention with the detachable plate cylinder and inking module configured in an alternate mode of operation from that shown in FIG. 3 to allow the detachable plate cylinder to act upon the press blanket cylinder.

The inking module 16 is supported by two bearings 27, whose detachable caps 28 (FIG. 5) hold the shafts 29A (FIG. 9) in position, thus enabling the inking module 16 to follow the slight movements of the shaft 9 (FIG. 3) of the additional blanket cylinder 7C for the application of pressure when the press is printing and for the relaxing of pressure when it is stopped. The ability to remove quickly the caps 28 (FIG. 5) of the bearings 27 makes it possible to change over very quickly from the arrangement shown in FIG. 3, using the additional blanket cylinder 7C fastened to the shaft 9 provided for carrying the numberers, to the arrangement shown in FIG. 4 in which the plate cylinder 17 of the inking module 16 is used to apply the ink of the second color to the blanket of the blanket cylinder 3, the ink of the first color having already been applied to it by the plate cylinder 2 of the press. In this arrangement the numbering and additional letterpress color system is normally used.

Figure 5:
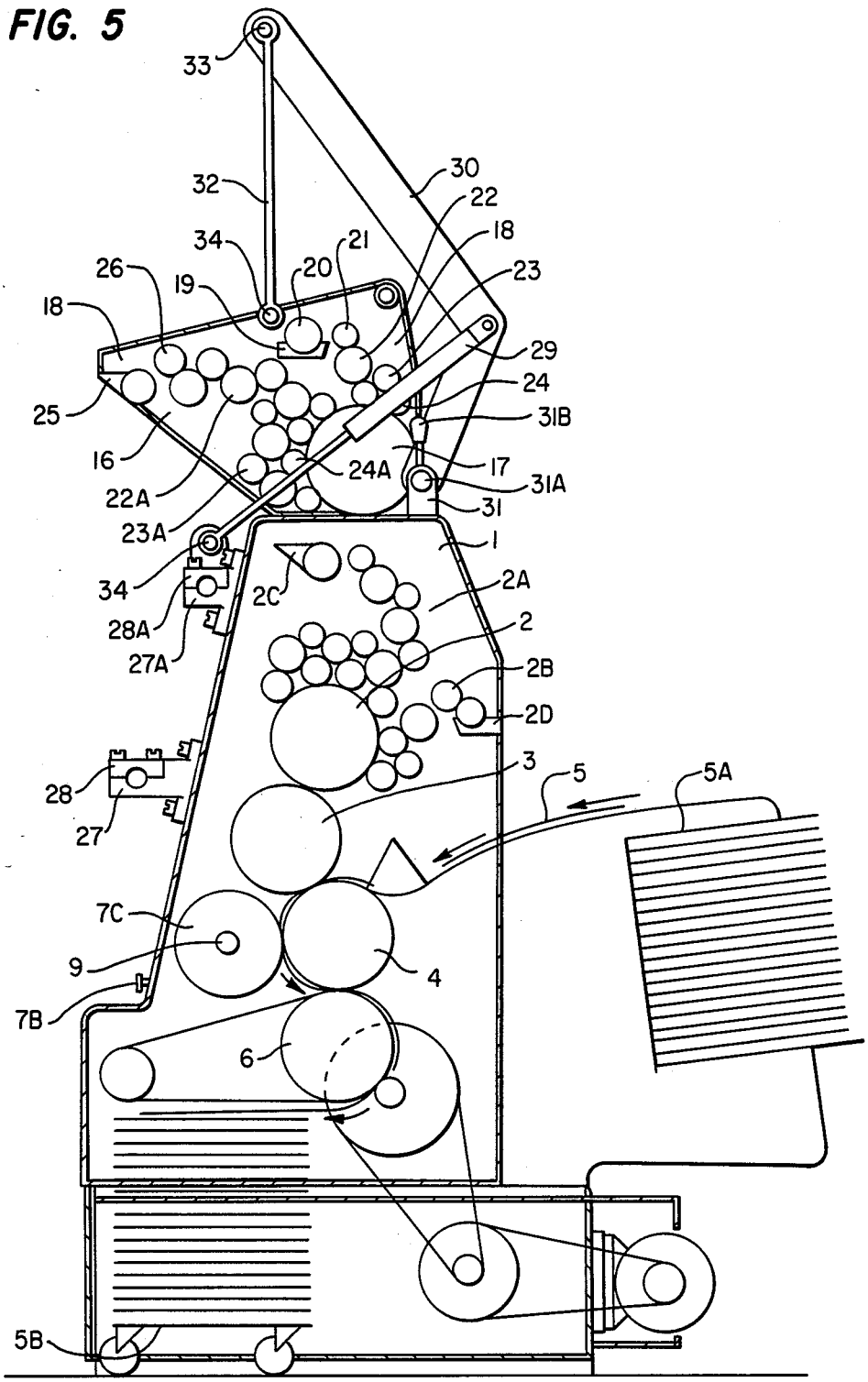
FIG. 5 is a view of the improved printing press of the present invention in a storage position.

FIG. 5 shows the inking module 16 in the stored position, out of use.

For greater ease and greater accuracy in the movement and positioning of the inking module 16, manipulation is assisted by a mechanism which retracts during printing and which works in the following manner. Pneumatic struts 29 bear against the frame 1 of the press, and lifting arms pivoted on the bearings 31 fixed on the frame 1 of the press raise the inking module 16 by means of connecting rods 32 pivoted on the arms 30 by the pins 33 and on the inking module 16 by the pins 34. An eccentric shaft 31A operated by a lever 31B enables the device to be deposited on the top of the printing press frame in the position of rest.

The invention, as characterized in the claims, is described below in detail with the aid of the drawings accompanying the text and illustrating one of the preferred embodiments in its different printing versions and fitted to a GTO Heidelberg press.

Figure 6A:
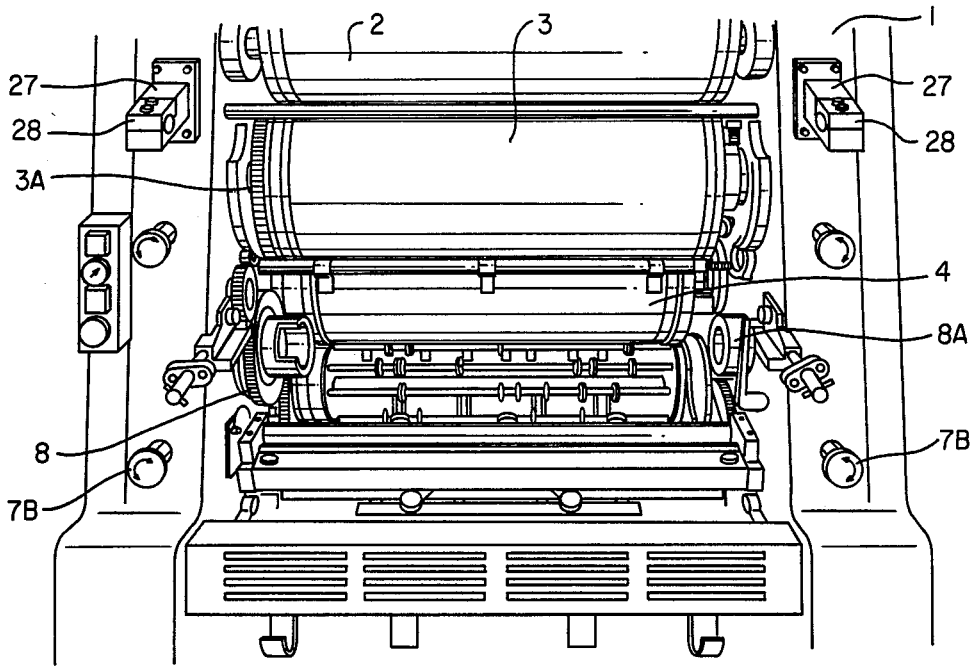
FIG. 6A PRIOR ART
FIG. 6A is a view of the prior art press from the delivery side of the blanket cylinder.
Figure 6B:
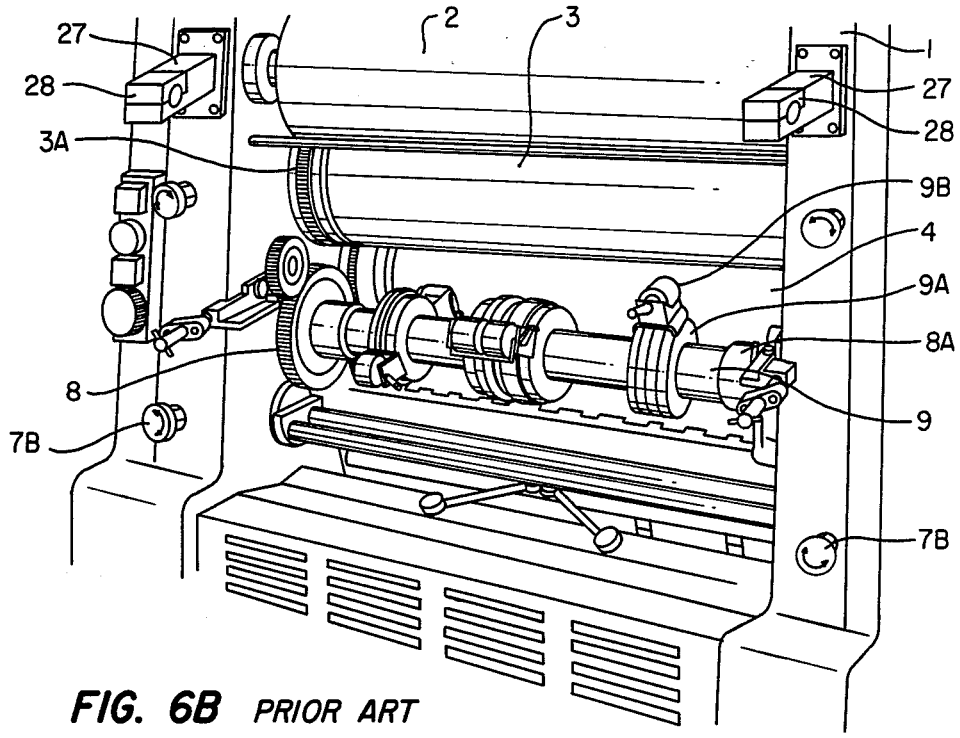
FIG. 6B PRIOR ART
FIG. 6B is a view of the prior art press with the numbering cylinder of the detachable dual mode numbering and additional coloring device connected thereto, shown in a numbering configuration.

FIG. 6, View A, is a front view on the press delivery side of the blanket cylinder 3 on which is fixed and adjusted a gear 3A enabling the inking module 16 (FIG. 3) to be driven in the position for printing two superimposed colors. The gear 8 (FIG. 6) serves as a power take-off driving the shaft 9 serving as rotating support either for the disks 9A (FIG. 6, View B) on which the numberers 9B are fixed, or for the sleeve 9C (FIG. 7, view A) to which the letterpress blocks are secured by adhesive bonding, or else for the performance of the invention for the blanket cylinder 7C (FIG. 7, View B) on which the plate cylinder 17 (FIG. 3) of the inking module 16 will deposit ink from its plate representing the image to be printed. The micrometer screws 7B (FIG. 2) for pressure adjustment, which are provided for letterpress printing, serve the same function for offset printing. The bearings 27 and 27A and their caps 28 and 28A enable the inking module 16 (FIG. 3) to be supported and positioned on the press in its two operating positions. The ring 8A (FIG. 6, View A) positions and serves as support for the bearing 9D (FIG. 8, View A) of the movable support shaft 9 (FIG. 6, View B). The device for the automatic release of pressure in the event of no sheet being fed also operates for two-color offset printing.

FIG. 6, View B, shows the same section of the press as View A, and in addition shows the rotating support shaft 9 connected to the power take-off gear 8 and the ring 8A serving to support it, said shaft turning in phase with the machine and carrying, mounted on it before it is fitted, the disks 9A and the numberers 9B.

Figure 7A:
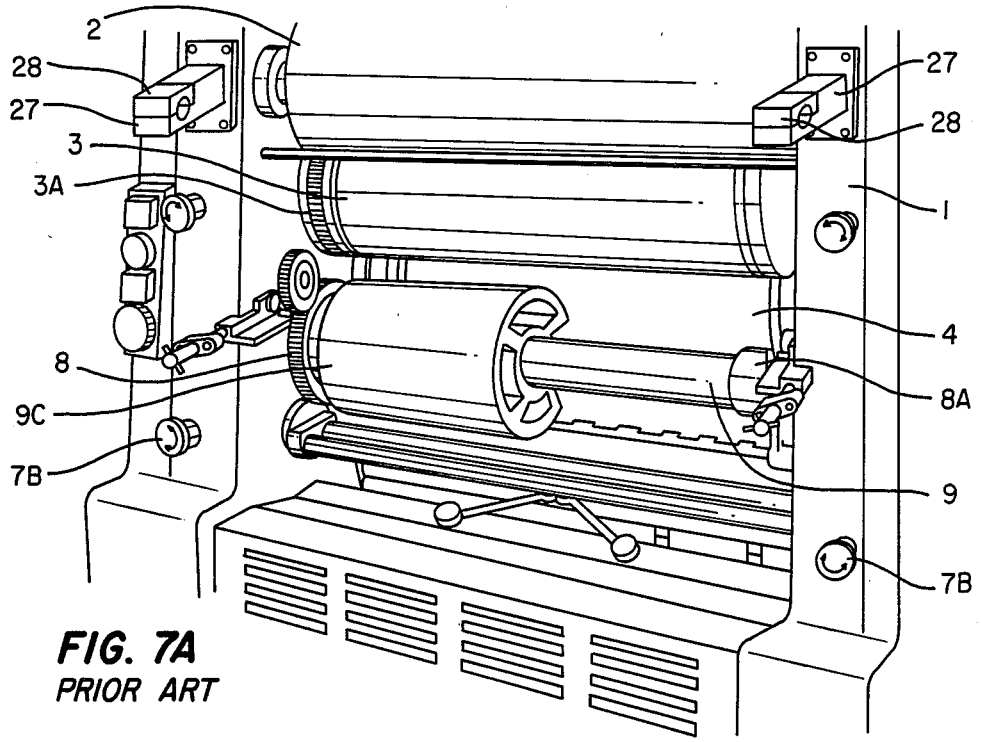
FIG. 7A PRIOR ART
FIG. 7A is a view of the prior art press with the coloring cylinder of the detachable dual mode numbering and additional coloring device connected thereto, shown in an additional coloring configuration.
Figure 7B:
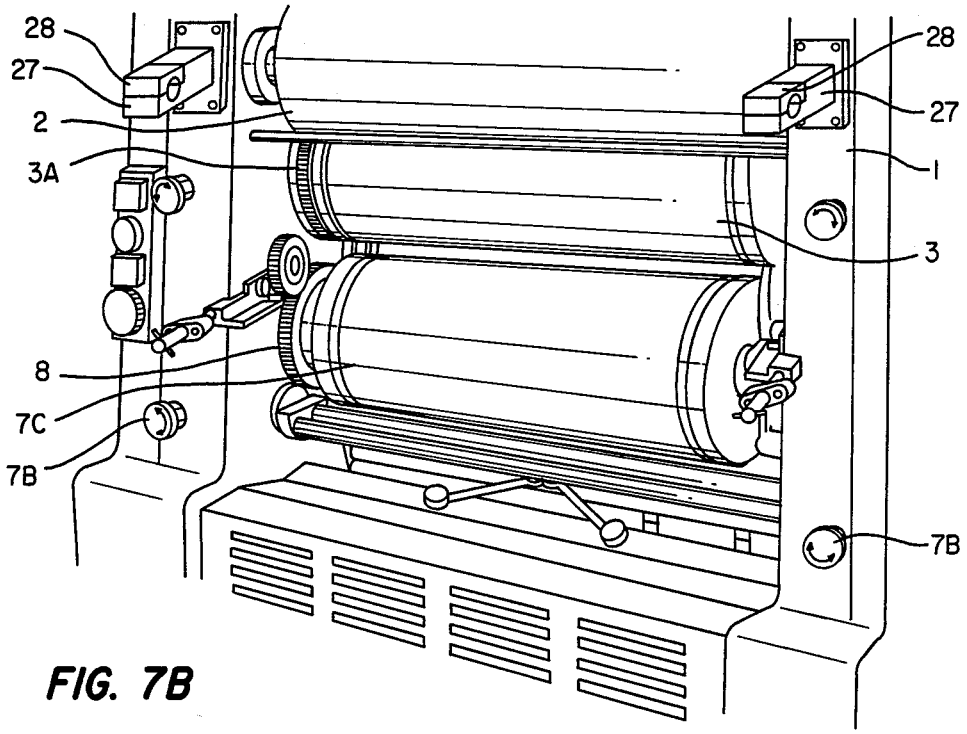
FIG. 7B is a view of the improved printing press of the present invention from the delivery side of the blanket cylinder with an auxiliary blanket cylinder coupled in place of the numbering/coloring cylinders.

FIG. 7, View A, shows, for the sake of good understanding of the invention, the same section in which the disks 9A (FIG. 6, View B) carrying the numberers 9B have been replaced by the sleeve 9C (FIG. 7, View A), on which are fixed the letterpress blocks and which is mounted on the same rotating support shaft 9.

FIG. 7, View B, shows the same section, in which the sleeve 9C (FIG. 7, View A) has been replaced with the blanket cylinder 7C, provided with its impression blanket 7D and mounted on the rotary support shaft 9 driven by the gear 8.

Figures 8A, 8B:
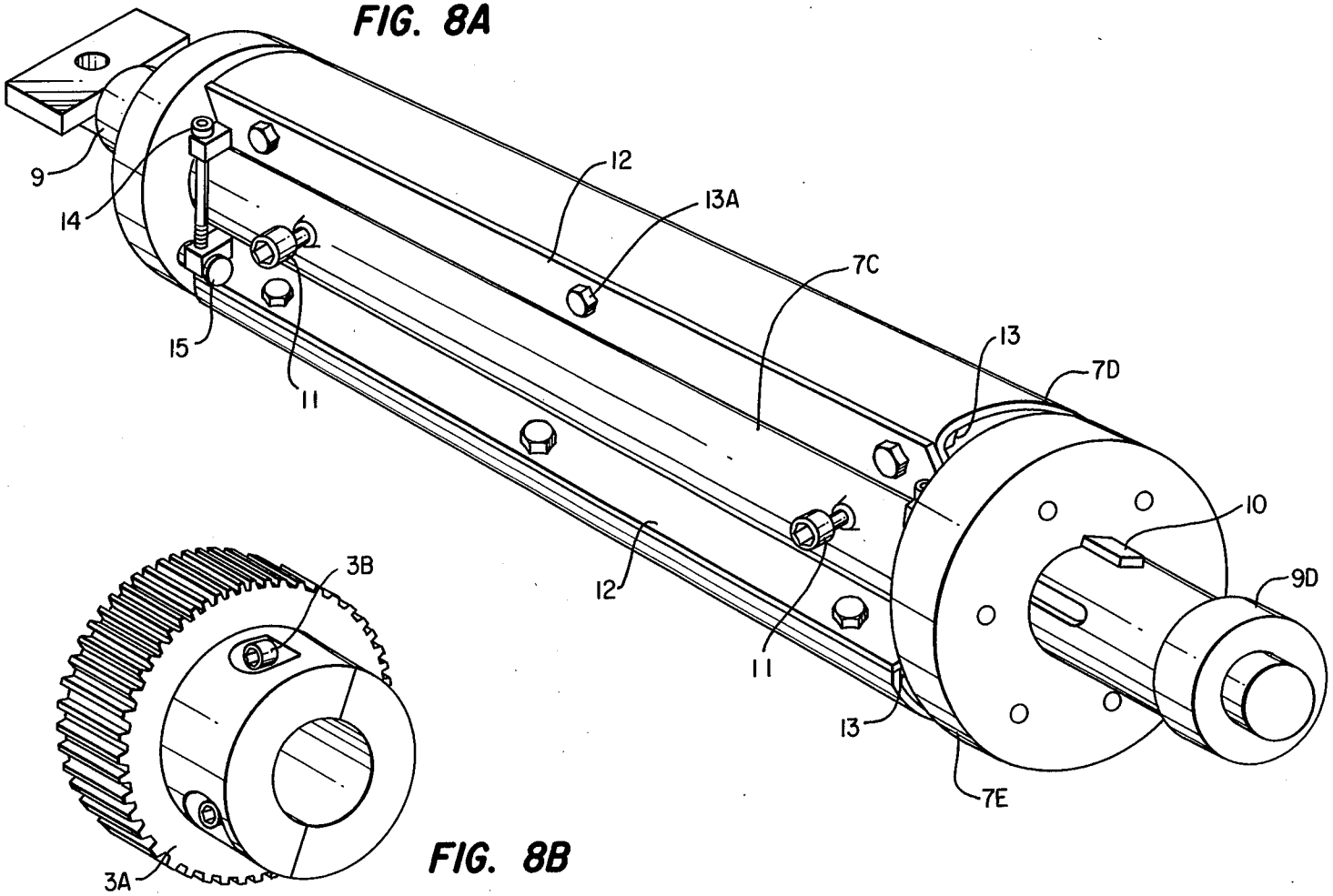
FIG. 8A is a view of the auxiliary blanket cylinder of the present invention.
FIG. 8B is a view of a gear which is coupled to the prior art press to accommodate the operation of the auxiliary blanket cylinder and detachable module.

FIG. 8, View A, shows a construction of the blanket cylinder 7C mounted on the rotating shaft 9 driving it. The rotating shaft 9 drives the blanket cylinder 7C directly, said cylinder being prevented from turning on said shaft by the key 10 and from making translatory movements by the stop screws 11. The blanket 7D is gripped between the tensioning bars 12 and the clamp bars 13 held by the screws 13A. The tightening of the spherical head screws 14 effects the normal tensioning of the blanket 7D by being screwed into the cylindrical nuts 15, which brings about the rocking of the tensioning bars 12 on the blanket cylinder 7C.

FIG. 8, View B, shows the gear 3A permanently positioned on the shaft of the blanket cylinder 3 (FIG. 6). In cases where the inking unit is fitted to existing presses, this gear is made in two halves in order to enable it to be installed without having to dismantle the printing press. It is machined with extreme precision in order to ensure perfect rotation of the gear teeth, without eccentricity or wobble. The screws 3B hold the two gear halves together, and at the same time ensure clamping on the blanket cylinder shaft by a pinching action.

Figure 9:
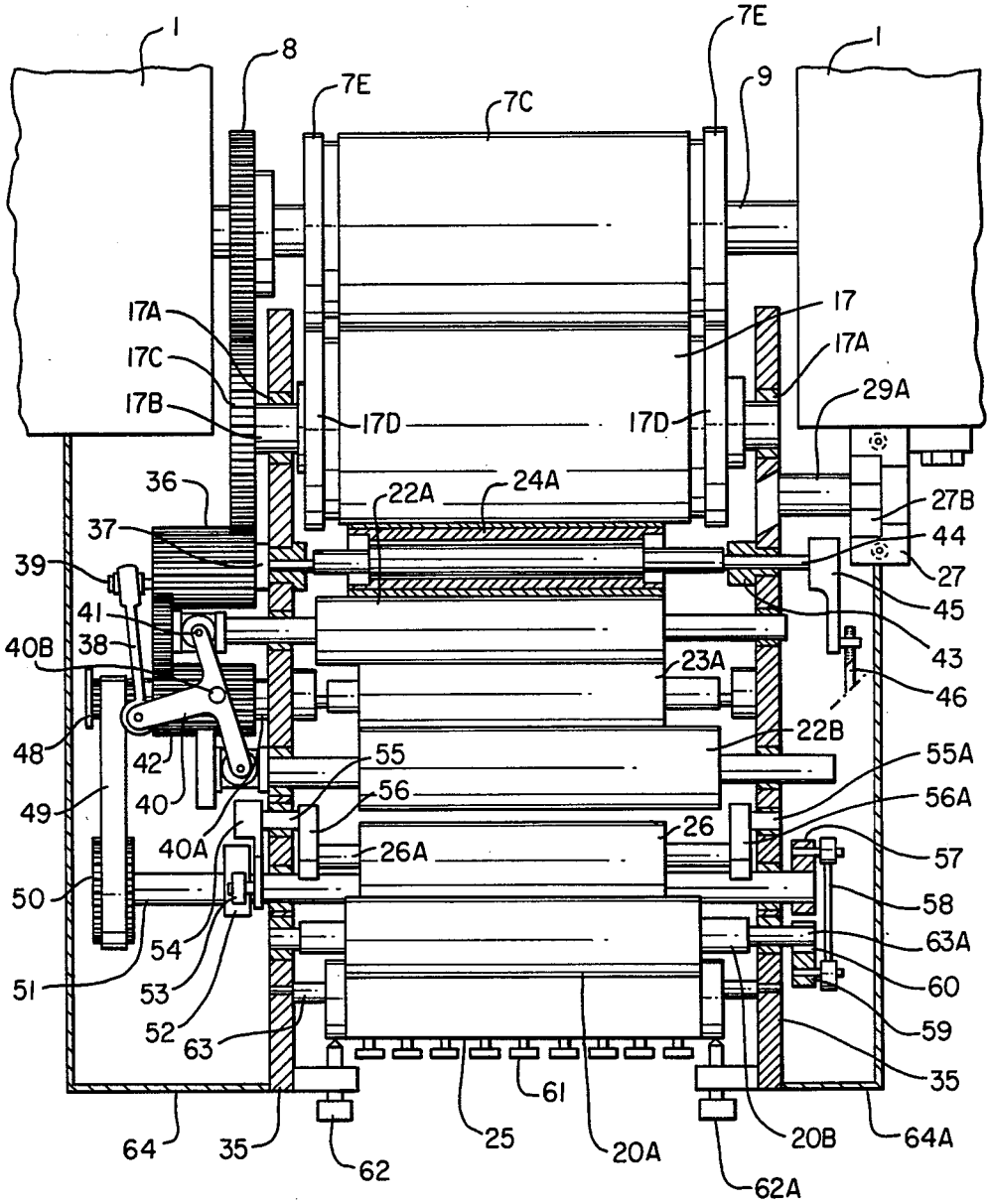
FIG. 9 is a partial sectional view of the detachable auxiliary plate cylinder and inking module of the present invention.
Figure 10:
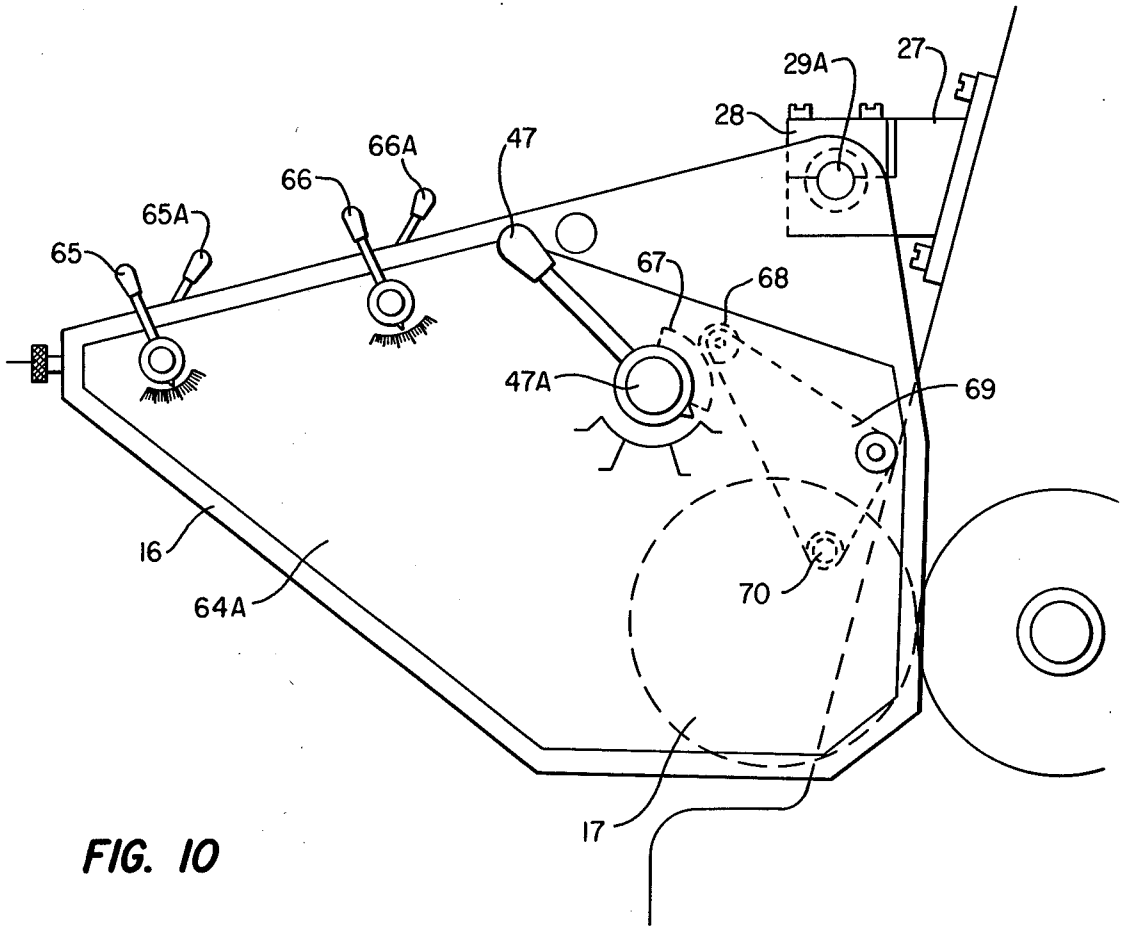
FIG. 10 is a side view of the detachable auxiliary plate cylinder and inking module of the present invention.

FIG. 9 shows a partial section of the inking module 16, illustrating the general principles applied for depositing the ink on the blanket cylinder 7C. The plates 35 supporting the components of the inking module 16 are attached to the printing press by means of shafts 29*a* pivoting in the supports 27 with the aid of ball bearings 27B. The plate cylinder 17 turning in its bearings 17A carries at one end of its shaft 17B the gear 17C keyed on it and driven rotationally by the drive gear 3C of the printing press. The gear 36 turning on its stationary shaft 37 operates the connecting rod 38 by means of the eccentric crankpin 39 mounted on a ball joint. The connecting rod 38 in turn moves the lever 40 which is pivoted on the support 40A by means of the pin 40B and whose rollers 41 alternately push to the right, and then to the left, the sliding tables 22A and 22B serving to grind the ink. These tables are driven rotationally by the gear 36 and the gear 42, the number of teeth of which enables them to obtain the same circumferential speed as the plate cylinder 17, the ink transfer rollers 23A and plate inking rollers 24A thus being driven by simple contact with light pressure. This pressure is adjusted by the combined rotations of the eccentric bearings 43 acting on the pressure against the sliding table 22A, and of the eccentric shaft 44 of the plate inking rollers 24A acting on the pressure against the plate on the plate cylinder 17. One end of the eccentric shaft 44 carries a crank 45 connected by a connecting rod 46 to the single control lever 47 (FIG. 10). Each plate inking roller 24A (FIG. 3) and plate moistening roller 24 is connected in the same manner to the single control lever 47 (FIG.

10). Depending on the position of the latter, it is possible to bring the assembly of plate inking rollers 24A or the assembly of plate moistening rollers 24 into or out of contact with the plate on the plate cylinder 17 (FIG. 3). The gear 42 (FIG. 9) carries at one end a cogged pulley 48 which with the aid of a cogged belt 49 turns the cogged pulley 50 keyed on the shaft 51 with a reduction ratio such that the shaft 51 makes one rotation for every format printed. The cam 52 keyed on the shaft 51 thus raises the cam roller 53 fixed at the end of the lever 54 for each impression cycle. The lever 54 is keyed to one end of the shaft 55, to the other end of which is keyed the lever 56, which thus permits the to-and-fro movement of the ink feed roller 26 turning on the shaft 26a fixed at one end on the lever 56 and at the other end on the lever 56A pivoted on the shaft 55A. In the forward movement the ink feed roller 26, bearing against the ink ductor 20A of the duct 25, becomes coated with ink, which it deposits on the sliding table 22B at the end of the return movement. The rotating shaft 51 carries at one end the crank 57, on which pivots the connecting rod 58 fixed to the lever 59. This lever is mounted pivotally on the shaft 20B of the ink ductor roller 20A with the aid of the free wheel 60. In its oscillation, the movement of the lever 59 thus turns the ink ductor roller 20A a few degrees in the same direction with the aid of the free wheel 60, which roller is thus coated in the ink reservoir 25, the flow from which is ensured by adjustment screws 61. Screws 62 and 62A keep the ink reservoir 25 closed, although it can be opened for washing by turning it about pins 63 and 63A. It should be noted that the kinematics of the moistening liquid distribution system is in general arranged in the same manner as the kinematics of the ink distribution system. Protective casings 64 and 64a prevent direct access to the mechanical systems, which could be dangerous to the user.

FIG. 10 shows the inking module 16 on which all the controls necessary for the correct use of the module are disposed. The lever 65, with index and graduated scale, regulates the amplitude of the rotary movement of the ink ductor roller 20A (FIG. 9) by acting on the pawl of he free wheel 60. The lever 65A (FIG. 10) enables the ink ductor roller 20A (FIG. 9) to be turned by hand. The screws 61 regulate the coating of the ink ductor roller 20A, thus acting, conjointly with the selection of the position of the lever 65 (FIG. 10), on the amount of ink deposited on the plate on the plate cylinder 17. The lever 66, which is also provided with an index and graduated scale, regulates the amplitude of the rotation of the moistening liquid ductor roller 20 (FIG. 3), thus acting directly on the flow of liquid deposited on the plate on the plate cylinder 17. The lever 66A enables the moistening liquid ductor roller 20 (FIG. 3) to be turned by hand. Judicious adjustment of the screws 61 (FIG. 10) and of the levers 65 and 66 thus makes it possible to deposit on the plate on the plate cylinder 17 the amount of ink and moistening liquid most suitable for an excellent impression. The single four-position control lever 47 selects the different functions. In the "stop" position the connecting rods 46 (FIG. 9), which are not completely shown for the sake of clarity in the drawing and which are controlled directly by the single control lever 47 (FIG. 10), push the levers 45 (FIG. 9) into a position such that the eccentric shafts 44 move the moistening rollers 24 (FIG. 3) and inking rollers 24A away from the plate cylinder 17. In the "moisten" position of the single control lever 47 (FIG. 10) only the connecting rods 46 (FIG. 9) controlling the plate moistening rollers 24 (FIG. 3) are operated, thus bringing these rollers to bear against the plate on the plate cylinder 17 in order to effect the necessary moistening of said plate. In the "inking" position, the plate inking rollers 24A are in turn brought to bear against the plate on the plate cylinder 17. It should be observed that these operations are carried out without the plate cylinder 17 (FIG. 10) coming into contact with the blanket cylinder 7C. A cam is in fact keyed on the shaft 47A of the single control lever 47 to act on the roller 68 of the lever 69 pivoted by the pin 70 on a plate 35 of the inking module 16. The lever 69 bears directly against the frame 1 of the printing press to pivot the inking module 16 on its pivot pins 29A. In the "print" position the single control lever 47 turns the cam 67, the depression on which causes the lever 69 to pivot and the inking module 16 to rock in such a manner that the running tracks 17D (FIG. 9), known as bearers, of the plate cylinder 17 come to bear against the bearers 7E of the blanket cylinder 7C. The pressure is applied between plate and blanket, thus enabling ink to be transferred from the plate on the plate cylinder 17 to the blanket on the blanket cylinder 7C. The impression can now be made by pressing the sheet 6 (FIG. 3) between the pressure cylinder 4 and the blanket cylinder 7C.

Within the scope of the invention presses of larger formats can be equipped in the same way by employing the same means which characterize the invention in its claims taken as a whole.

I claim:

1. In a printing press having:

a plate cylinder;

a means for linking said plate cylinder in a first color with a first ink;

a blanket cylinder in circumferential contact with said plate cylinder for receiving images from said plate cylinder in said first ink;

a pressure cylinder in adjustable circumferential contact with said blanket cylinder;

a feed means for drawing paper between said pressure cylinder and said blanket cylinder to deposit said images in said first ink on said paper;

a drive means for rotating said plate cylinder, blanket cylinder, and said pressure cylinder;

a detachable dual mode numbering and coloring device including a inking unit in circumferential contact with a removable numbering cylinder, said removable numbering cylinder being in circumferential contact with said pressure cylinder and rotated by said drive means, for printing page numbers on said paper drawn between said removable numbering cylinder and said pressure cylinder when in a numbering mode, and with said inking unit in circumferential contact with a removable coloring cylinder, said removable coloring cylinder being in circumferential contact with said pressure cylinder and rotated by said drive means, for printing images in a second ink of a second color on said paper drawn between said removable coloring cylinder and said pressure cylinder when in a coloring mode;

the improvement comprising:

a removable auxiliary blanket cylinder adapted for attachment in the press in the location provided for the removable numbering and coloring cylinders, and for rotation by said drive means; and a movable inking module coupled to said printing press, including an inking unit, a damping unit, and an auxiliary plate cylinder, operable in a first mode with said auxiliary plate cylinder in circumferential contact with said auxiliary blanket cylinder for depositing images in a third ink of a third color on said paper, and operable in a second mode with said auxiliary plate cylinder in circumferential contact with said blanket cylinder for depositing images in a third ink of a third color on said paper while allowing simultaneous operation of said detachable dual mode numbering and color device.

2. A printing press according to claim 2, wherein the said movable inking module is suspended along said press by a pivoting arm.

3. A printing press according to claim 2, wherein said movable inking module is suspended along said press by a pivoting arm and configurable in three positions relative to said press, including a first position with said auxiliary plate cylinder in circumferential contact with said auxiliary blanket cylinder in said first mode of operation, a second position with said auxiliary plate cylinder in circumferential contact with said blanket cylinder in said second mode of operation, and a third position with said movable inking module placed in a storage position.

4. A printing press comprising in combination:

a plate cylinder;

a means for inking said plate cylinder in a first color with a first ink;

a blanket cylinder in circumferential contact with said plate cylinder for receiving images from said plate cylinder in said first ink;

a pressure cylinder in adjustable circumferential contact with said blanket cylinder;

a feed means for drawing paper between said pressure cylinder and said blanket cylinder to deposit said images in said first ink on said paper;

a drive means for rotating said plate cylinder, blanket cylinder, and said pressure cylinder;

a removable auxiliary blanket cylinder adapted for attachment in the press adjacent said pressure cylinder and rotatably by said drive means;

a movable inking module coupled to said printing press, including an inking unit, a damping unit, and an auxiliary plate cylinder, operable in a first mode with said auxiliary plate cylinder in circumferential contact with said auxiliary blanket cylinder for depositing images in a second ink of a second color on said paper, and operable in a second mode with said auxiliary plate cylinder in circumferential contact with said blanket cylinder for depositing images in a second ink of a second color on said paper.

5. A printing press according to claim 4, wherein movable inking module is suspended along said press by a pivoting arm.

6. A printing press according to claim 5, wherein said movable inking module is suspended along said press by a pivoting arm and configurable in three positions relative to said press, including a first position with said auxiliary plate cylinder in circumferential contact with said auxiliary blanket cylinder in said first mode of operation, a second position with said auxiliary plate cylinder in circumferential contact with said blanket cylinder in said second mode of operation, and a third position with said movable inking module placed in a storage position.

* * * * *